US006311861B1

(12) United States Patent
Policappelli

(10) Patent No.: US 6,311,861 B1
(45) **Date of Patent: *Nov. 6, 2001**

(54) LAMINATED CONTAINER

(76) Inventor: Nini Policappelli, 361 N. Robertson Blvd., Los Angeles, CA (US) 90048

( * ) Notice: Subject to any disclaimer, the term of this patent is extended or adjusted under 35 U.S.C. 154(b) by 0 days.

This patent is subject to a terminal disclaimer.

(21) Appl. No.: 09/391,642

(22) Filed: Sep. 7, 1999

Related U.S. Application Data

(63) Continuation of application No. 08/977,348, filed on Nov. 24, 1997, which is a continuation-in-part of application No. 08/524,089, filed on Sep. 7, 1995, now Pat. No. 5,762,230, which is a continuation-in-part of application No. 08/378,461, filed on Jan. 26, 1995, now Pat. No. 5,586,681, which is a continuation-in-part of application No. 08/029,791, filed on Mar. 11, 1993, now abandoned.

(51) Int. Cl.[7] ..... B65D 6/38; B65D 8/12

(52) U.S. Cl. ..... 220/669; 220/674; 220/906

(58) Field of Search ..... 220/669, 265, 220/266, 269, 270, 62.14, 619, 674, 670, 906, 907, 672, 673, 220, 413, 72, 347, 101; 101/35, 36, 37, 38.1, 39–44; 347/106; D9/530, 531, 550, 567, 555, 554, 535, 541, 563; 413/18; 72/46

(56) References Cited

U.S. PATENT DOCUMENTS

| | | |
|---|---|---|
| D. 3,243 | 11/1868 | French . |
| D. 22,304 | 3/1893 | Heinz . |
| D. 40,138 | 7/1909 | Schramm . |
| D. 47,527 | 6/1915 | Sanford . |
| D. 48,371 | 1/1916 | Goldberg . |
| D. 53,694 | 8/1919 | Taylor . |
| D. 55,892 | 7/1920 | Scudder et al. . |
| D. 56,029 | 9/1920 | Quigg . |
| D. 60,591 | 3/1922 | Tyner . |
| D. 62,053 | 3/1923 | Borokoff . |

(List continued on next page.)

FOREIGN PATENT DOCUMENTS

| | | |
|---|---|---|
| 869172 | 7/1949 | (DE) . |
| 2 308 420 | 10/1974 | (DE) . |
| 0 441 618 A1 | 8/1991 | (EP) . |
| 661.255 | 7/1929 | (FR) . |

(List continued on next page.)

OTHER PUBLICATIONS

Prepare for Quantum, The Canmaker, May 1992 pp 52–54.
*The Canner*"Diacut", Mar. 1995, p. 3.
Joseph B. Cahill, "Firm Builds Coke Can With Curves", Aug. 7, 1995, Crain's Chicago Business, vol. 18, No. 32, p. 4.

*Primary Examiner*—Allan N. Shoap
*Assistant Examiner*—Niki M. Eloshway
(74) *Attorney, Agent, or Firm*—Oppenheimer Wolff & Donnelly LLP

(57) ABSTRACT

A container for a fluid comprises an elongated body portion having first end and second end. There is a top portion sealing the second end and having an aperture. A cover member is provided for sealing the aperture. The top portion is movable between a first position in which the container is sealed and a second position for permitting removal of the cover member. The body portion is of a flexible material which could formed of aluminum or plastic. The top is a lid including a corrugated surface extendable between a compressed position contained in a first position in relation to the body portion and second position substantially relatively further removed from the body portion. The corrugated surface includes circular formations, the formations being eccentrically formed relative to the aperture. Alternatively the corrugated surface includes spiral formations substantially centered about the aperture. The top is formed selectively of at least one of a material being a vinyl, paper, plastic, metal, or laminate material.

6 Claims, 15 Drawing Sheets

U.S. PATENT DOCUMENTS

| | | | | |
|---|---|---|---|---|
| D. 63,724 | | 1/1924 | Marble . | |
| D. 64,007 | | 2/1924 | Harkey . | |
| D. 64,637 | | 5/1924 | Mas . | |
| D. 64,816 | | 6/1924 | Sears . | |
| D. 65,589 | | 9/1924 | Mas . | |
| D. 67,465 | | 6/1925 | Johnson . | |
| D. 68,413 | | 10/1925 | Thom . | |
| D. 68,873 | | 11/1925 | Rosenstein . | |
| D. 68,874 | | 11/1925 | Rosenstein . | |
| D. 69,176 | | 1/1926 | Curran . | |
| D. 69,462 | | 2/1926 | Sears . | |
| D. 70,183 | | 5/1926 | Miller . | |
| D. 70,359 | | 6/1926 | Curran . | |
| D. 70,855 | | 8/1926 | Oppenheim, Jr. . | |
| D. 72,141 | | 3/1927 | Boswell . | |
| D. 74,894 | | 4/1928 | Onthank . | |
| D. 75,763 | | 7/1928 | Annis . | |
| D. 75,903 | | 7/1928 | Dupiech . | |
| D. 92,786 | | 7/1934 | Vivaudou . | |
| D. 94,573 | | 2/1935 | Steelman . | |
| D. 99,407 | | 4/1936 | McManus . | |
| D. 110,882 | | 8/1938 | Smith . | |
| D. 111,411 | | 9/1938 | D'Addario . | |
| D. 111,794 | | 10/1938 | Oswell . | |
| D. 112,381 | | 11/1938 | Sauer, Jr. . | |
| D. 127,918 | | 6/1941 | Wilson . | |
| D. 158,279 | | 4/1950 | Heftler-Louiche . | |
| D. 170,153 | | 10/1953 | Hennessy . | |
| D. 179,507 | | 1/1957 | Barbiers . | |
| D. 179,934 | | 3/1957 | Currie, Jr. . | |
| D. 185,296 | | 5/1959 | Mas . | |
| D. 185,557 | | 6/1959 | Mas . | |
| D. 193,158 | | 7/1962 | Buonauro . | |
| D. 199,579 | | 11/1964 | Davis . | |
| D. 200,222 | | 2/1965 | Du Pree . | |
| D. 200,792 | | 4/1965 | Eyles . | |
| D. 209,714 | | 12/1967 | Evans et al. . | |
| D. 213,544 | | 3/1969 | Koenigsberg . | |
| D. 222,340 | | 10/1971 | Weckman . | |
| D. 227,658 | | 7/1973 | Bagguley et al. . | |
| D. 228,444 | | 9/1973 | Mascia et al. . | |
| D. 231,972 | | 7/1974 | Mitchell . | |
| D. 238,552 | | 1/1976 | Edwards et al. . | |
| D. 238,553 | | 1/1976 | Edwards et al. . | |
| D. 246,229 | | 11/1977 | Saunders . | |
| D. 249,121 | | 8/1978 | Strand . | |
| D. 250,933 | | 1/1979 | Saunders . | |
| D. 257,314 | | 10/1980 | Robison et al. . | |
| D. 257,427 | | 10/1980 | Cooke et al. . | |
| D. 262,439 | | 12/1981 | Atkinson et al. . | |
| D. 263,024 | | 2/1982 | Atkinson et al. . | |
| D. 263,450 | | 3/1982 | Dutcher et al. . | |
| D. 264,434 | | 5/1982 | Pettengill . | |
| D. 264,435 | | 5/1982 | Pettengill . | |
| D. 264,436 | | 5/1982 | Pettengill . | |
| D. 268,789 | | 4/1983 | Harper et al. . | |
| D. 271,281 | | 11/1983 | Abbott et al. . | |
| D. 283,011 | | 3/1986 | Moloney et al. . | |
| D. 289,736 | | 5/1987 | Bowers, Jr. . | |
| D. 291,283 | | 8/1987 | Taylor . | |
| D. 294,464 | | 3/1988 | Rogler . | |
| D. 297,089 | | 8/1988 | West . | |
| D. 320,153 | * | 9/1991 | Cassai et al. | D9/355 |
| D. 330,676 | | 11/1992 | Halasz et al. . | |
| D. 332,750 | | 1/1993 | Moloney et al. . | |
| 343,133 | | 6/1886 | Leighton et al. . | |
| D. 346,745 | | 5/1994 | Heynen et al. . | |
| D. 347,172 | | 5/1994 | Heynen et al. . | |
| D. 353,336 | | 12/1994 | Caliendo et al. . | |
| D. 353,337 | | 12/1994 | Halasz et al. . | |
| D. 356,264 | | 3/1995 | Praturlon et al. . | |
| D. 356,265 | | 3/1995 | Moloney et al. . | |
| D. 356,501 | | 3/1995 | Kerwick et al. . | |
| 397,163 | | 2/1889 | Zinsser, Jr. . | |
| 423,833 | | 3/1890 | Stiveson . | |
| 606,856 | | 7/1898 | Campen . | |
| 679,658 | | 7/1901 | Witt . | |
| 756,406 | | 4/1904 | Puddefoot et al. . | |
| 792,029 | | 6/1905 | Harker . | |
| 820,228 | | 5/1906 | Mauser . | |
| 1,014,491 | | 1/1912 | Lammine . | |
| 1,073,897 | | 9/1913 | Goss . | |
| 1,083,311 | | 1/1914 | Weber . | |
| 1,262,289 | | 4/1918 | Weber . | |
| 1,262,766 | | 4/1918 | Foster . | |
| 1,711,644 | | 5/1929 | Mauser . | |
| 2,005,641 | | 6/1935 | Stanitz et al. . | |
| 2,063,013 | | 12/1936 | Cooper . | |
| 2,139,143 | | 12/1938 | Wiswell . | |
| 2,340,473 | | 2/1944 | Johnson . | |
| 2,457,198 | | 12/1948 | Bell . | |
| 2,563,352 | | 8/1951 | Morse . | |
| 2,617,559 | | 11/1952 | van der Spek . | |
| 2,685,316 | | 8/1954 | Krasno . | |
| 2,715,089 | | 8/1955 | Michener et al. . | |
| 2,869,753 | | 1/1959 | Jankowski . | |
| 2,932,437 | | 4/1960 | Wilcox . | |
| 2,935,108 | | 5/1960 | Hall . | |
| 3,061,129 | * | 10/1962 | Fitz Gerald | 215/395 |
| 3,075,666 | | 1/1963 | Hoffstein . | |
| 3,083,877 | | 4/1963 | Gash . | |
| 3,123,273 | | 3/1964 | Miller . | |
| 3,167,210 | | 1/1965 | Carney, Jr. . | |
| 3,194,468 | | 7/1965 | Baron . | |
| 3,236,697 | | 2/1966 | Amiet et al. . | |
| 3,306,488 | | 2/1967 | Lemelson . | |
| 3,317,110 | | 5/1967 | Palmer . | |
| 3,335,902 | | 8/1967 | Javorik . | |
| 3,349,956 | | 10/1967 | Stephan . | |
| 3,356,209 | | 12/1967 | Pezely, Jr. . | |
| 3,357,593 | | 12/1967 | Sears, Jr. et al. . | |
| 3,385,501 | | 5/1968 | Chang . | |
| 3,397,820 | | 8/1968 | Smith . | |
| 3,401,826 | | 9/1968 | Anthony . | |
| 3,402,871 | | 9/1968 | Palmer . | |
| 3,474,844 | | 10/1969 | Lindstrom et al. . | |
| 3,547,299 | | 12/1970 | Kepple . | |
| 3,547,308 | | 12/1970 | Gilliem . | |
| 3,557,788 | | 1/1971 | Swartz . | |
| 3,558,001 | | 1/1971 | Fritz et al. . | |
| 3,563,408 | | 2/1971 | Bijvoet . | |
| 3,673,954 | * | 7/1972 | Lala | 101/40 |
| 3,825,151 | | 7/1974 | Arnaud . | |
| 3,872,994 | | 3/1975 | Hyde . | |
| 3,918,603 | | 11/1975 | Hatada . | |
| 3,940,001 | | 2/1976 | Haefner et al. . | |
| 4,024,975 | | 5/1977 | Uhlig . | |
| 4,050,605 | | 9/1977 | Wakana . | |
| 4,074,279 | * | 2/1978 | Ikeda et al. | 347/106 |
| 4,090,635 | | 5/1978 | Nelson et al. . | |
| 4,155,474 | | 5/1979 | Bizzarri . | |
| 4,167,234 | | 9/1979 | Gordon et al. . | |
| 4,169,537 | | 10/1979 | Sabreen et al. . | |
| 4,185,749 | | 1/1980 | Vartia . | |
| 4,228,913 | | 10/1980 | Mack et al. . | |
| 4,324,340 | | 4/1982 | Belokin, Jr. . | |
| 4,325,490 | | 4/1982 | Conrad . | |
| 4,356,927 | | 11/1982 | Cooper et al. . | |
| 4,403,709 | | 9/1983 | Meins et al. . | |
| 4,407,425 | | 10/1983 | Combs . | |
| 4,413,748 | | 11/1983 | Kessler et al. . | |

| | | | | |
|---|---|---|---|---|
| 4,415,097 | | 11/1983 | Meins . | |
| 4,428,498 | | 1/1984 | Obey . | |
| 4,441,640 | | 4/1984 | Lottick . | |
| 4,512,490 | | 4/1985 | Frei et al. . | |
| 4,538,439 | | 9/1985 | Frei . | |
| 4,572,412 | | 2/1986 | Brach et al. . | |
| 4,609,113 | | 9/1986 | Seki . | |
| 4,622,026 | | 11/1986 | Ito et al. . | |
| 4,645,078 | | 2/1987 | Reyner . | |
| 4,685,582 | | 8/1987 | Pulciani et al. . | |
| 4,700,867 | | 10/1987 | Dutt et al. . | |
| 4,708,257 | | 11/1987 | Deline . | |
| 4,709,829 | | 12/1987 | Johnson et al. . | |
| 4,723,681 | | 2/1988 | Glerum . | |
| 4,750,634 | | 6/1988 | Herman . | |
| 4,756,440 | | 7/1988 | Gartner . | |
| 4,775,564 | | 10/1988 | Shriver et al. . | |
| 4,798,605 | | 1/1989 | Steiner et al. . | |
| 4,803,922 | * | 2/1989 | Dennesen | 101/41 |
| 4,872,576 | | 10/1989 | Nakamura . | |
| 4,877,141 | | 10/1989 | Hayashi et al. . | |
| 4,877,148 | | 10/1989 | Larson et al. . | |
| 4,941,573 | | 7/1990 | Fuerstman . | |
| 4,953,706 | | 9/1990 | Piccard . | |
| 5,002,199 | | 3/1991 | Frahm . | |
| 5,031,786 | | 7/1991 | Ingram et al. . | |
| 5,040,698 | | 8/1991 | Ramsey et al. . | |
| 5,070,801 | | 12/1991 | Frederick . | |
| 5,100,017 | | 3/1992 | Ishinabe et al. . | |
| 5,148,930 | | 9/1992 | Ota et al. . | |
| 5,158,190 | | 10/1992 | Sosenko . | |
| 5,174,469 | | 12/1992 | Policappelli . | |
| 5,178,289 | * | 1/1993 | Krishnakumar et al. | 220/674 X |
| 5,203,490 | | 4/1993 | Roe . | |
| 5,299,700 | | 4/1994 | Benicar . | |
| 5,361,935 | | 11/1994 | Sagucio . | |
| 5,482,175 | | 1/1996 | Arrar . | |
| 5,522,524 | | 6/1996 | Nmngani . | |
| 5,586,681 | | 12/1996 | Policappelli . | |
| 5,762,230 | * | 6/1998 | Policappelli | 220/662 |

FOREIGN PATENT DOCUMENTS

| | | |
|---|---|---|
| 207333 | 1/1940 | (FR) . |
| 924.042 | 7/1947 | (FR) . |
| 954.957 | 1/1950 | (FR) . |
| 1.472.123 | 1/1967 | (FR) . |
| 7633204 | 10/1976 | (FR) . |
| 312 | 7/1915 | (GB) . |
| 243947 | 10/1925 | (GB) . |
| 703836 | 2/1954 | (GB) . |
| 1120576 | 7/1968 | (GB) . |
| 2100219A | 12/1982 | (GB) . |
| 2 250 972 A | 6/1992 | (GB) . |
| 2 266 290A | 10/1993 | (GB) . |
| 654091 | 5/1963 | (IT) . |
| 668757 | 10/1964 | (IT) . |
| 694406 | 9/1965 | (IT) . |
| 4-87939 | 3/1992 | (JP) . |
| WO 92/1110 | 7/1992 | (WO) . |

* cited by examiner

LAMINATED CONTAINER

This is a continuation application of U.S. Ser. No. 08/977,348, filed Nov. 24, 1997, which is a continuation-in-part of U.S. Ser. No. 08/524,089, filed Sep. 7, 1995 and issued as U.S. Pat. No. 5,762,230, which is a continuation-in-part of U.S. Ser. No. 08/378,461, filed Jan. 26, 1995 and issued as U.S. Pat. No. 5,586,681, which is a continuation-in-part of U.S. Ser. No. 08/029,791, filed Mar. 11, 1993 and abandoned.

BACKGROUND

This invention relates to a top for a container for fluids.

In particular, this invention relates to a container for fluids such as beverages, the container having an enhanced top. The container with its top is more effective for dispensing fluids and is relatively more attractive than existing containers.

Traditional beverage containers typically have smooth cylindrical surfaces, the container being of a size that can easily be grasped by a user. The top portion or lid of the container is generally fixed in relation to the container body and is of a planar structure. There is usually provided a lift-off or partly removable seal or cover to an aperture in the lid or top. This aperture in the top can provide dangers hygienically. Sometimes the seal is removed and can enter the container causing dangers of choking.

There is a need for a container having a top or lid portion that offers a better facility to the user, minimizes the hygienic problems, and the dangers to the user.

It would be advantageous to provide a container and top having unique effects which is environmentally and economically efficient.

SUMMARY

The present invention provides a top and a can which seeks to minimize the disadvantages presented by the prior art.

By this invention, there is a provided a top portion or lid for a container. The container has an elongated body portion with a first end which is sealed. The top portion seals a second end, and the top has an aperture. A cover member is provided for sealing the aperture.

The top portion is movable between a first position in which the container is sealed and a second position for permitting removal of the cover member. In the second position the top portion is relatively removed from the container body portion.

When the container includes contents under pressure, such as a carbonated beverage, the pressure from the beverage in the container may, under appropriate circumstances, assist in forcing the top portion to the second position, manually removed from the container body.

The top or lid including a corrugated surface extendable between a compressed position. In this position it is contained in a first position in relation to the body portion. In a second position it is substantially relatively further removed from the body portion.

In one form, the corrugated surface includes circular formations, the formations being eccentrically formed relative to the aperture.

In one form of the invention the corrugated surface of the top portion includes substantially circular formations. The corrugated surface includes substantially concentric circular formations. Preferably, the formations are eccentrically formed relative to the aperture in the top portion.

The aperture may be centered in the top or off-center.

In another preferred form of the invention the corrugated surface of the top portion includes spiral formations substantially centered about the aperture.

There can be a protective element located substantially above the top portion, with at least part of the protective layer being removable to permit exposure of the top portion.

The top portion includes a peripheral ring for anchoring with the body portion of the container. The ring can be integrally formed with the top portion. The ring includes a flange for anchoring with the body portion.

The top is formed selectively of at least one of a material being a vinyl, paper, plastic, metal, or laminate material. In some case the top portion includes a memory material. The memory material can adopt one of multiple positions relative to the body portion of the container.

The body portion can be of a flexible material. This could be aluminum or plastic.

The invention also relates to a container using a combination of materials for its construction which is environmentally and economically advantageous.

The container and/or the top can be used where the fluid is a powder or liquid. The contents of the container can be anything which needs to be dispensed for human consumption through the mouth, pouring through a spout for any purpose including industrial and general consumer use. Further the container can be of any suitable material including what would is typically known as a bottle. The container can be manufactured by any appropriate technique, including vacuum forming.

The container and top of the present invention has applications in industrial, consumer, and recreational settings, and should not be considered limited to the specific embodiments shown in the drawings or described herein.

DRAWINGS

DESCRIPTION

Figure 1:
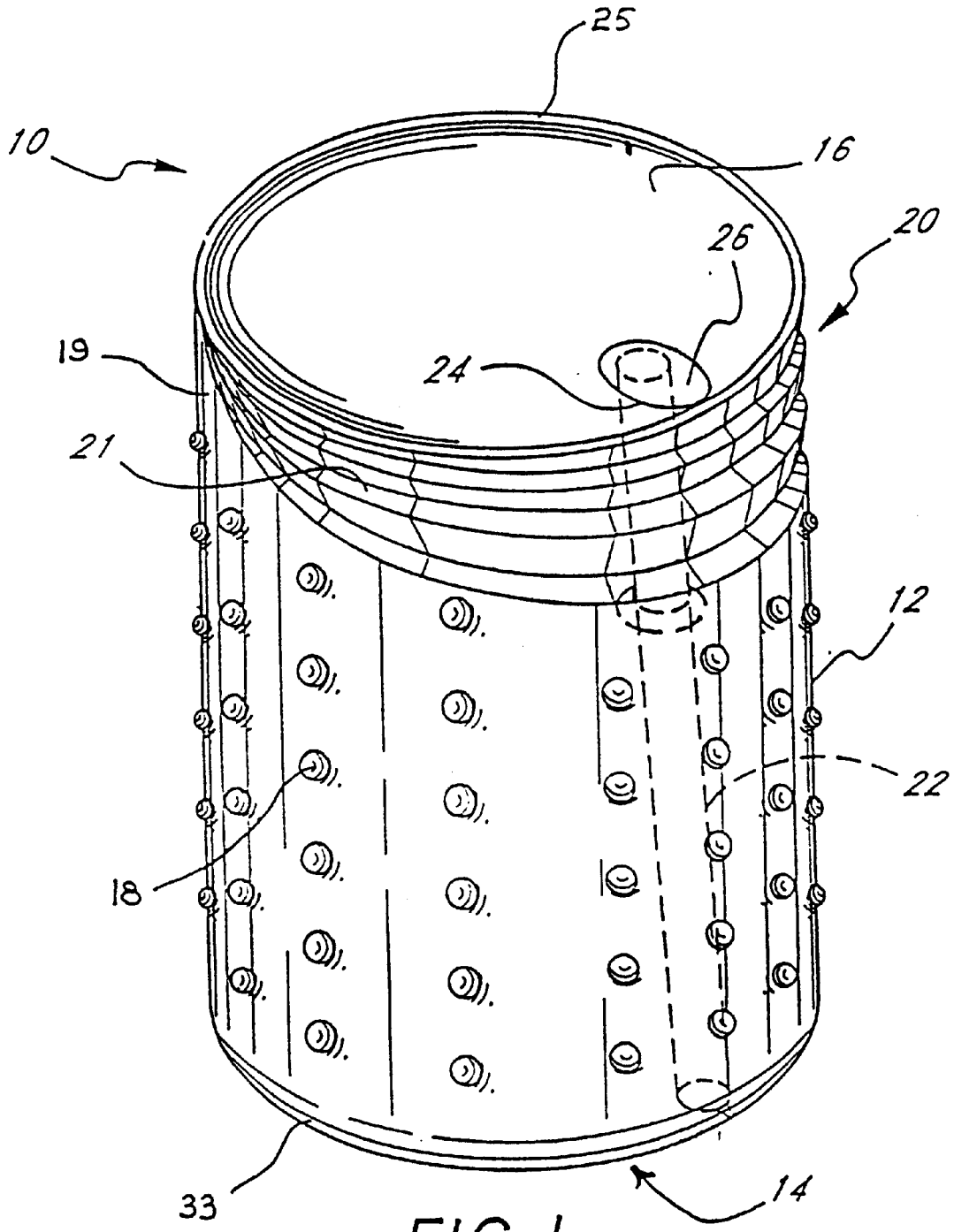
FIG. 1 is a perspective view of a container or beverage can illustrating a corrugated, collapsible portion near the upper surface of the container.

A container 10 for a fluid comprises an elongated body portion 17 having first end 11 and second end 13. A bottom portion or surface 14 seals the first end 11. A top portion 16 seals the second end 13 and the top portion 16 has an aperture 24. A cover member 26 is releasably secured to the top portion 16 for sealing the aperture 24 thereby to provide a closed cavity suitable for containing a fluid without fluid communication therethrough. The top portion 16 is movable between a first position in which the container 10 is sealed and a second position, namely an extended position for permitting removal of the cover member 26.

The top portion 16 is a lid which includes a corrugated or compressible surface 15. The corrugated surface is extendable between a compressed first position contained relatively in the body portion 17 and second position substantially relatively further removed from the body portion 17.

When the container 10 includes contents under pressure, such as a carbonated beverage, the pressure from the beverage in the container 10 may, under appropriate circumstances. assist in forcing the top portion 16 to the second position, relatively further removed from the container, body 17.

As illustrated in FIGS. 2–6, 12, 15 and 17 the corrugated surface 15 of the top portion 16 includes a series of substantially circular formations 19. The circular formations 19 are eccentrically formed relative to the aperture 24 in the top portion 16.

As illustrated in FIGS. 7–11 the corrugated surface 15 of the top portion 16 includes spiral formations 21 substantially centered about the aperture 24.

The aperture 24 is located substantially off-center relative to a perimeter 23 defined by the top portion 16.

The top portion 16 is formed selectively of at least one of a material being a vinyl, paper, plastic, metal, or laminate material. The top portion 16 can include a memory material. The memory material can adopt one of multiple positions relative to the body portion 12 of the container 10. The nature of the memory material is one where the position of repose would be in the extended position or location. Under stress it is compressed. In this manner the top 16 is movable between a sealed position with the container and a different extended position permitting removal of a cover 26.

Figure 4:
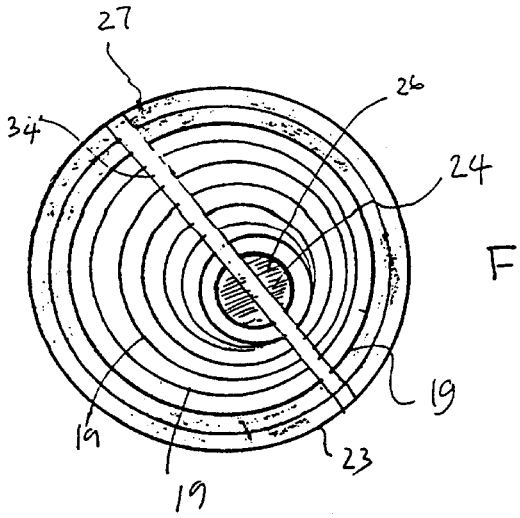
FIG. 4 is a top view of a top in an extended position.

As illustrated in FIG. 4 a protective element or cover 34 can be located substantially above the top portion 16. At least part of the protective layer 34 is removable to permit exposure of the top portion 16, and in particular, the aperture 24 and the cover 26. The cover member 26 may be a screw fitting or an element which is connected through a line of weakness with the perimeter about the aperture.

When it is a screw top fitting the cover member 26 has a skirt which is threaded to mate with threads on the outside of the spout 31. When there is a line of weakness this can be provided around the periphery of the spout 31 or on the top of the spout 31. Any different type of suitable closure can be provided to the top of the spout 31 as is typical in the closure of necks of containers, bottles or the top of beverage containers.

The top portion 16 also includes a peripheral ring 27 for anchoring with the body portion 17 of the container 10. The ring 27 can be integrally formed with the top portion 16. The ring 27 includes a flange 29 for anchoring with the body portion 17. The flange 29 may be integrally formed with the side walls or body potion 12 of the container 10, or the top 16 can be separately formed, and later flange connected with the side wall or body 12.

Figure 2:
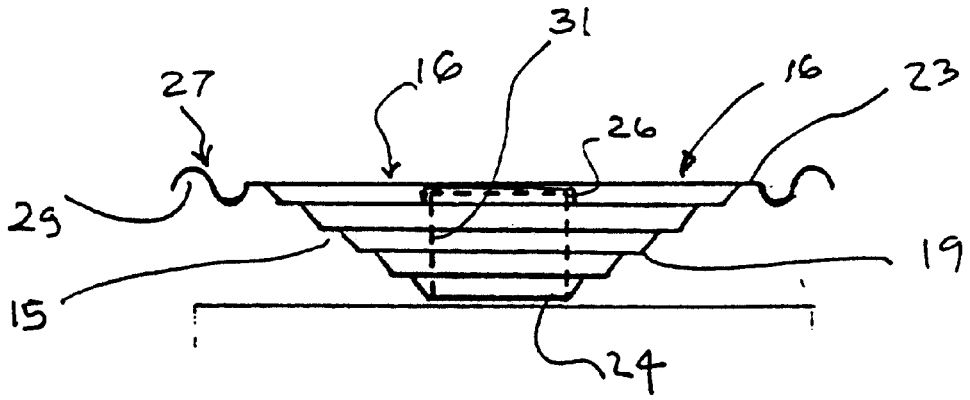
FIG. 2 is a side view of a top in a compressed state, namely the first position.

As illustrated in FIG. 2 the corrugated surface 15 is compressed relatively. The aperture 24 includes a spout-type formation 31 which is attached to the aperture 24. As illustrated, the top of the spout or mouthpiece 31 is provided with a cover 26 to seal aperture 24 and the contents in the container 10.

Figure 3:
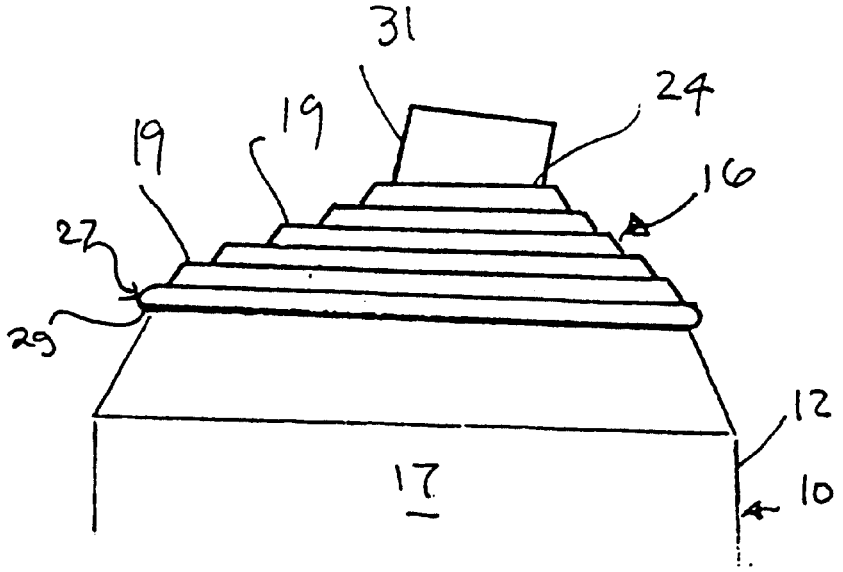
FIG. 3 is a side view of a top in an extended state, namely a second position relative to a container body.

As illustrated in FIG. 3 the spout 31 is extendable when the corrugated elements move to the second extended position relatively moved further from the side wall 12 of the body of the can 10. The corrugations 15 as illustrated in FIGS. 2, 3, 4, 5 and 6 have a relatively angulated straight profile. As viewed in the cross-sectional view in FIG. 5 the pattern of the corrugations is relatively zig-zagged with a series of apex points 35 and trough points 37. The corrugations 15 are circular but relatively eccentric about the spout 31 forming the outlet to the aperture 24.

As illustrated in FIG. 4 there is a cover 34 for securing the corrugated top 16 in a compressed position which is substantially flush as illustrated in FIG. 2. When in this position the cover 26 is secured over the mouth of the funnel 21 and hence the aperture 24 is covered. The protective cover or element 34 is a removable strip of metal, paper or plastic material. The ends of the protective element 34 can be secured with a flange 29 around the ring 27 of the top portion 16.

Figure 5:
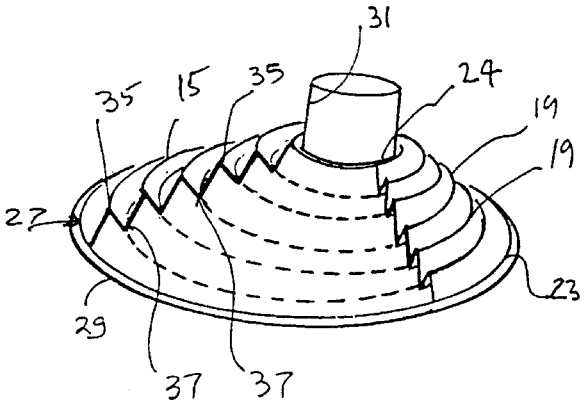
FIG. 5 is a perspective view of a top in an extended position.
Figure 6:
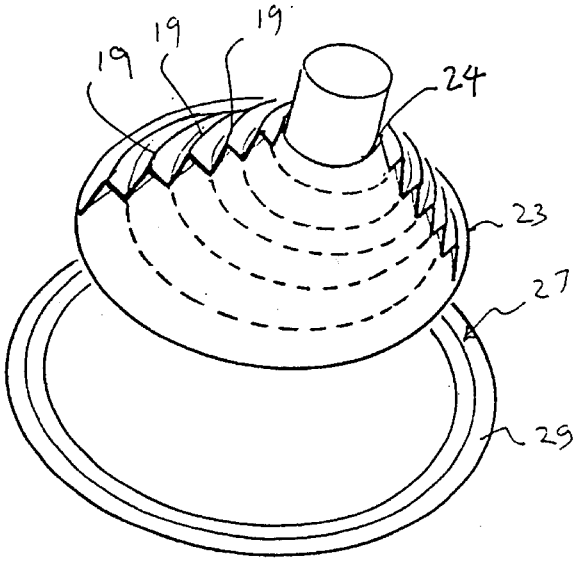
FIG. 6 is a perspective view of a top separated from a ring portion, the top being in an extended position.

Different geometric configurations can be provided for the corrugated sections 15 of the top portion 16. Thus, instead of their relatively triangular formations as illustrated in FIGS. 5 and 6, they can be rounded peaks and valleys.

Figure 7:
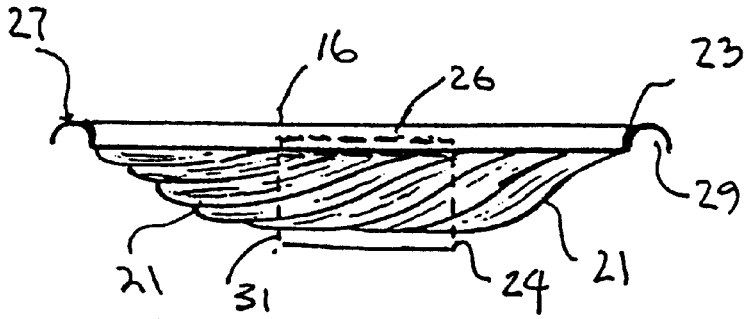
FIG. 7 is a side view of a different embodiment of a top in a compressed position, the top being a scrolled member.
Figure 8:
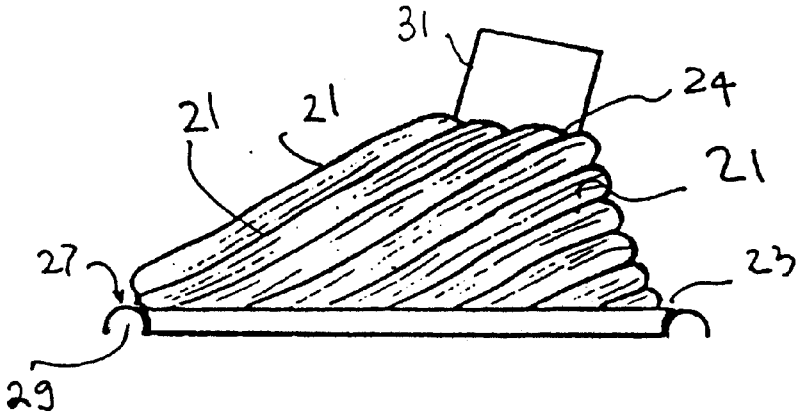
FIG. 8 is a side view of a top in an extended position.

As illustrated in FIGS. 7 and 8 there are spiral formations which form the corrugated surface. The spiral formations are relatively rounded and as the spout 31 is pulled or moved outwardly under pressure from the body of the can towards the second position, the spirals can seemingly unfold in a partially rotational manner. As illustrated in FIG. 7 in a closed first position the spout 31 is relatively centrally located and actually aligned relatively to the top portion geometry 16. As shown in the extended position the spout 31 is eccentrically aligned or off-center relative to the central axis.

Figure 9:
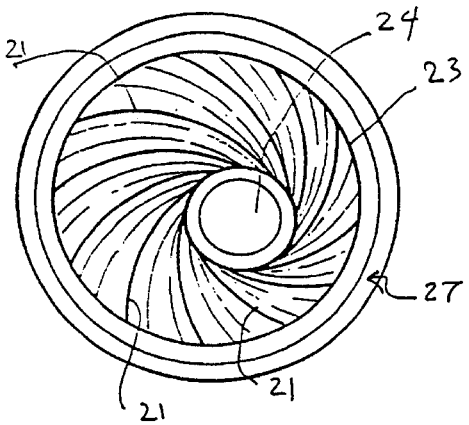
FIG. 9 is a top view of a top in an extended position.
Figure 10:
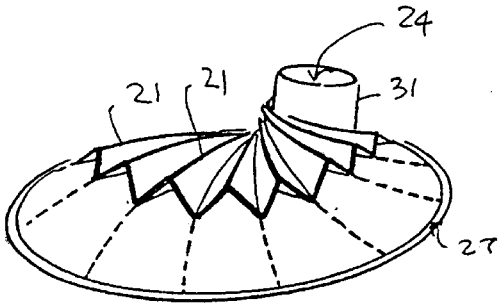
FIG. 10 is a perspective view of a top in an extended position.

In FIGS. 9 and 10 it is shown a top 16 with a spiralling formation which would also rotate about the spout 31. The cross-section of the corrugated surface is relatively straight and triangular. The lines of the corrugations when viewed from the top, are a relatively spiralling formation.

Figure 11:
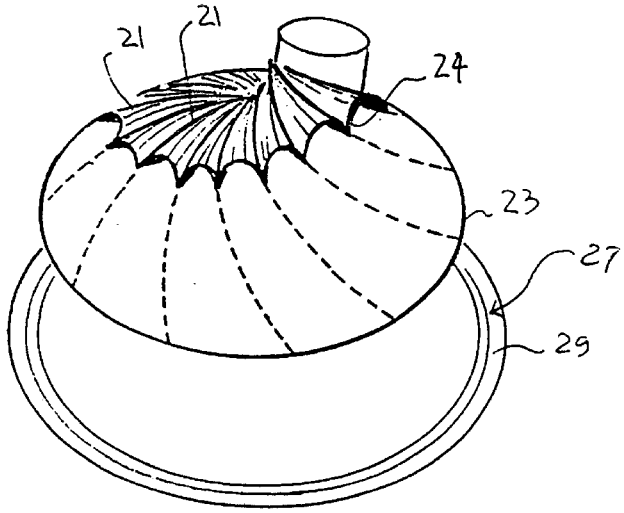
FIG. 11 is a perspective view of a top in an extended position separated from a ring which would be about a container.
Figure 12:
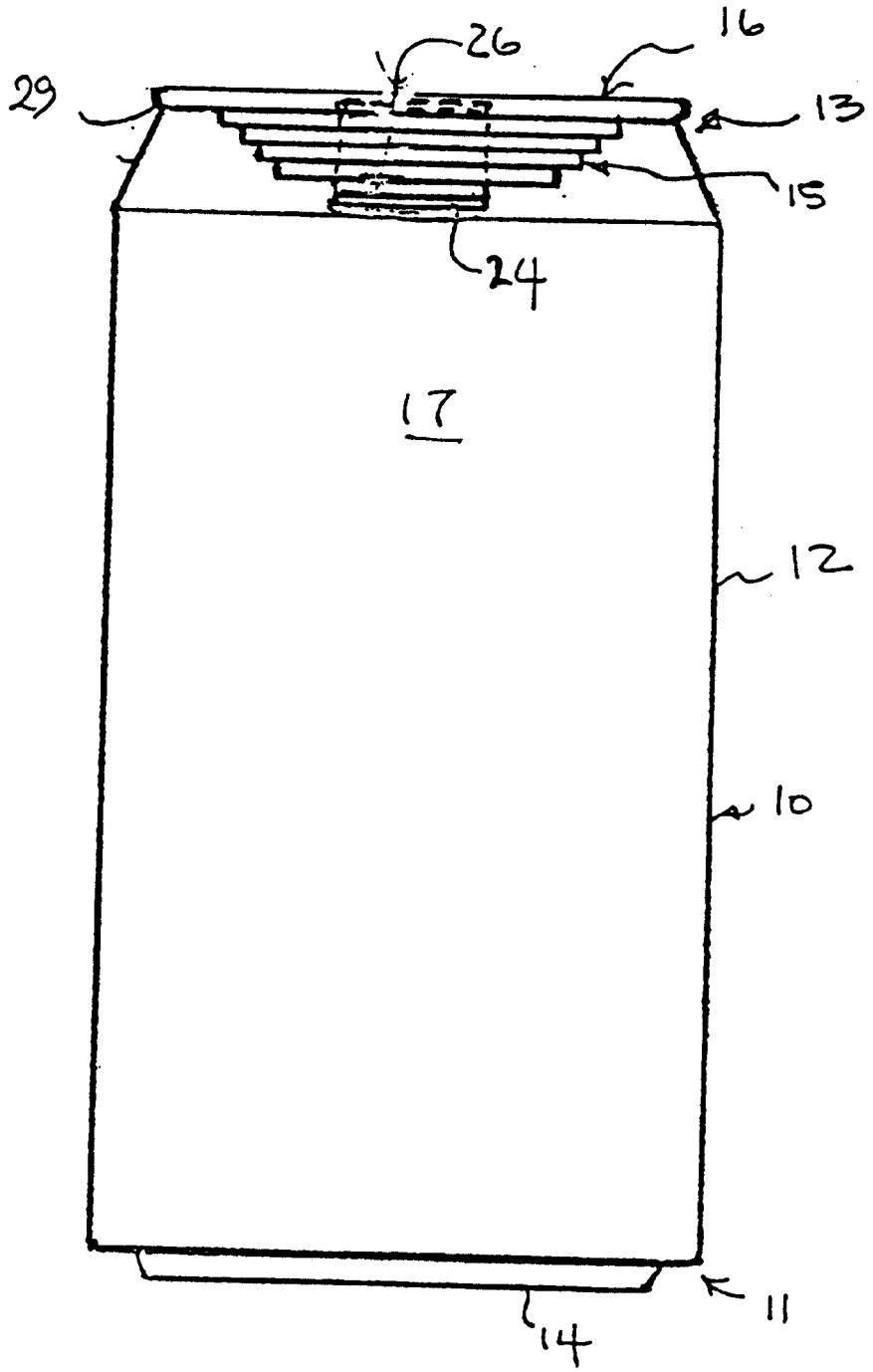
FIG. 12 is a side view of a container illustrating a top in a compressed position.
Figure 13:
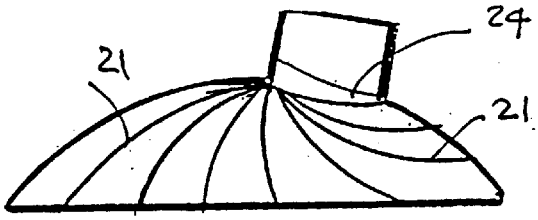
FIG. 13 is a side view of a top in an extended position.
Figure 14:
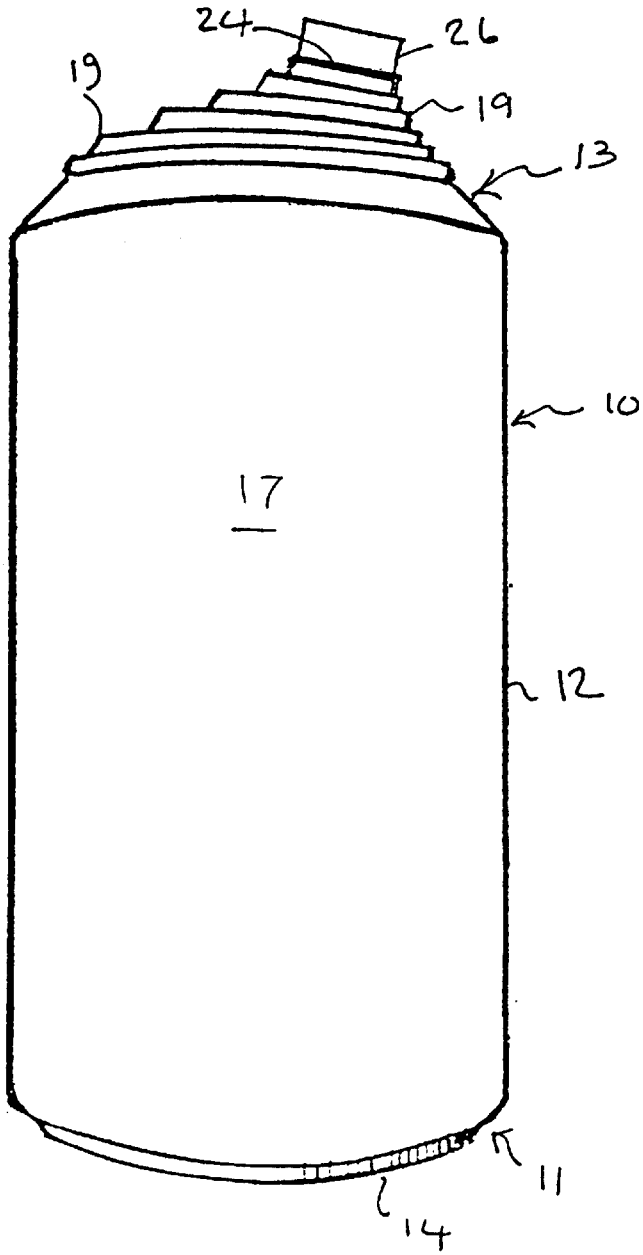
FIG. 14 is a perspective view of a container showing a top in an extended position.
Figure 15:
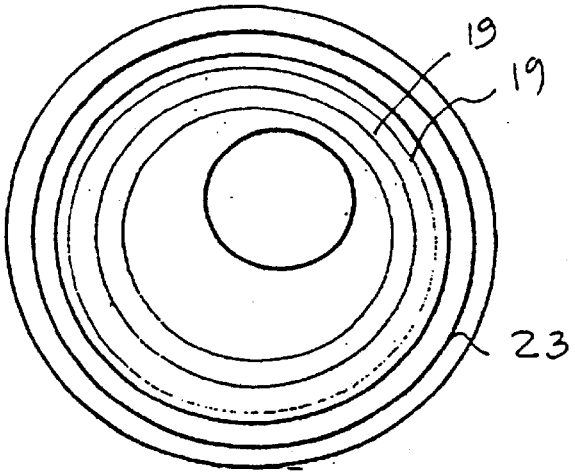
FIG. 15 is a top view of a top showing circular formations centrically arranged relative to an aperture offset from the center.
Figure 16:
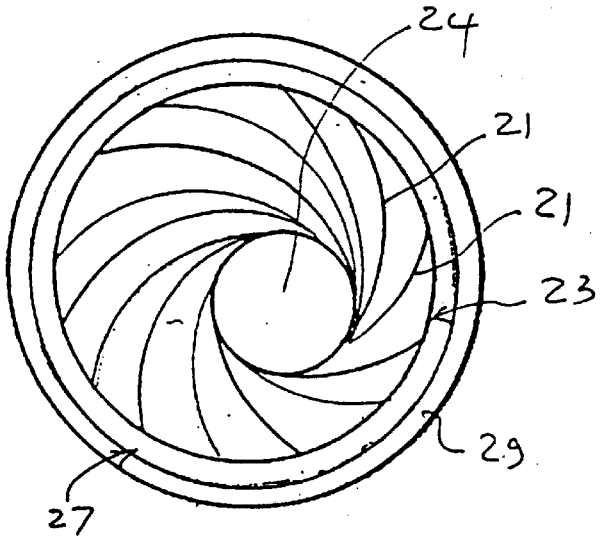
FIG. 16 is a top view of a top illustrating different forms of corrugations of a top with an aperture offset from the center of the top.
Figure 17:
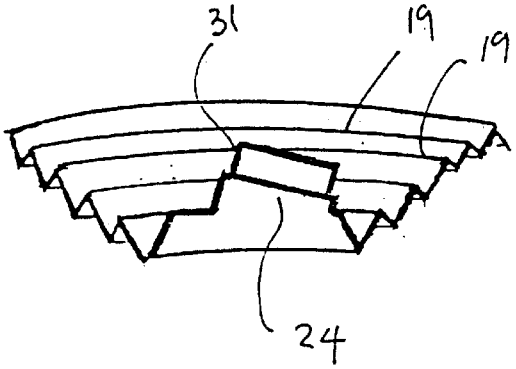
FIG. 17 is a perspective view showing a portion of a top in a compressed position.

As illustrated in FIG. 11 the cross-section of the spiralling formation include relatively semi-circular sections abutting relationship. In some other forms of the invention the aperture 24 for the container can be centrally located and the corrugations centrally formed about the central axis of the container 10.

In the arrangement of FIGS. 9, 10, 11, 13 and 16, a rotational movement can be applied to the top 16 to leave the top 16 to expand to its extended position.

The container 10 includes an exterior collapsible cylindrical surface 12, a bottom surface or portion 14 and a top surface 16. A rigid upper rim 25 connects the top portion or surface 16 with the cylindrical side 12. In a similar fashion, a rigid lower rim 33 connects the cylindrical side to the bottom surface 14.

In FIG. 1 there is a collapsible portion 20 of the substantially cylindrical container 10 located near the top portion or surface 16. The portion 16 in FIG. 1 is illustrated in a planar fashion. In terms of the invention however, the planar surface 16 would be replaced by a surface as illustrated in FIGS. 2–17.

In the original construction of the container 10, the opening 24 is closed or sealed by a portion of material comprising a cover 26 having the same configuration as the opening 24. This cover 26 is attached to the opening 24 on the container 10 by any means sufficient to cause a weakened state around the periphery of the cover which can be readily penetrated. For example, the opening 24 can preferably be formed simply by perforating the container top 16 in the configuration of the opening so that the perforations weaken the attachment of the cover 26 to the container.

Figure 18:
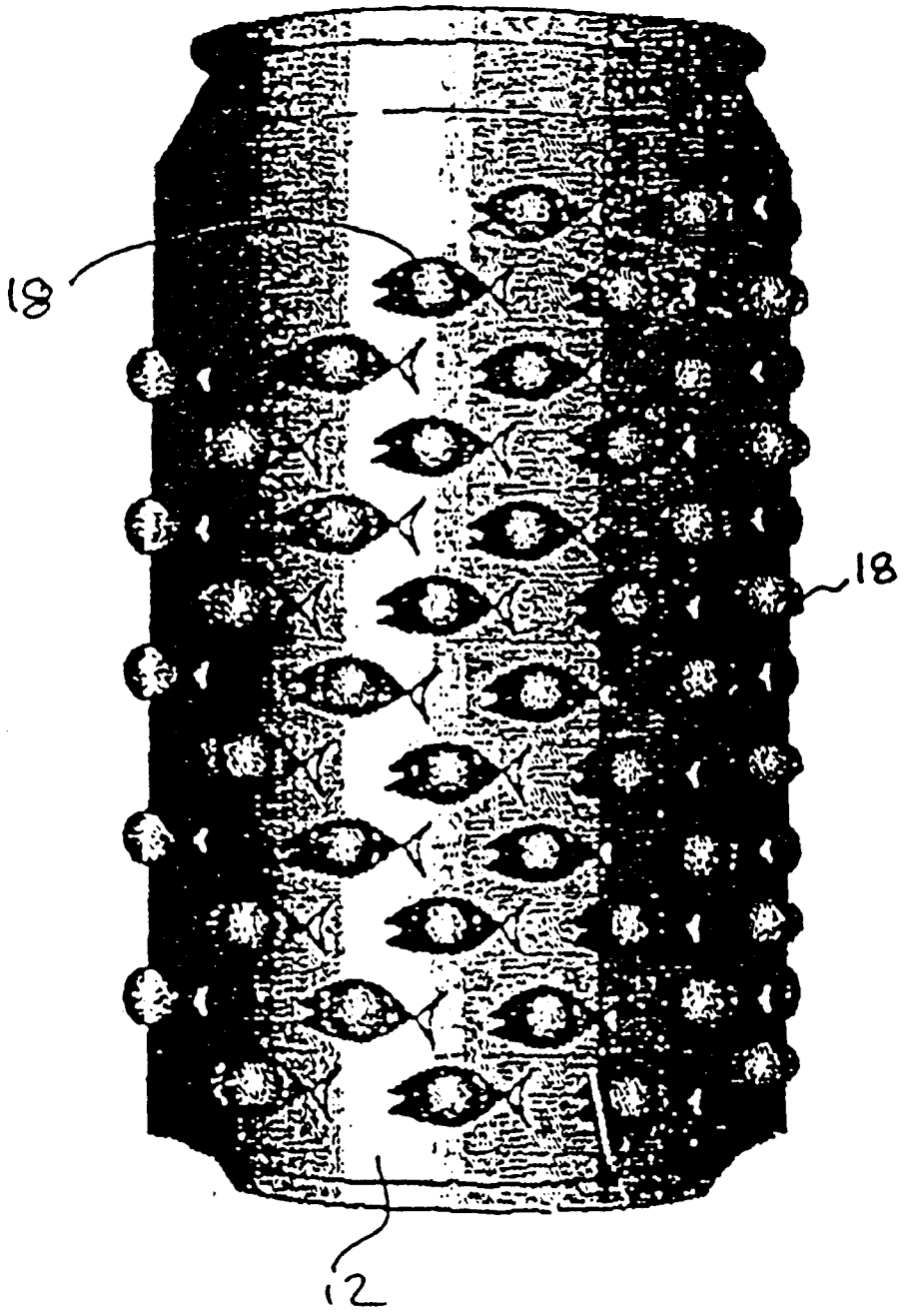
FIG. 18 is front view showing a standard can with a repetitive fish art work ornamental design on the surface.
Figure 19:
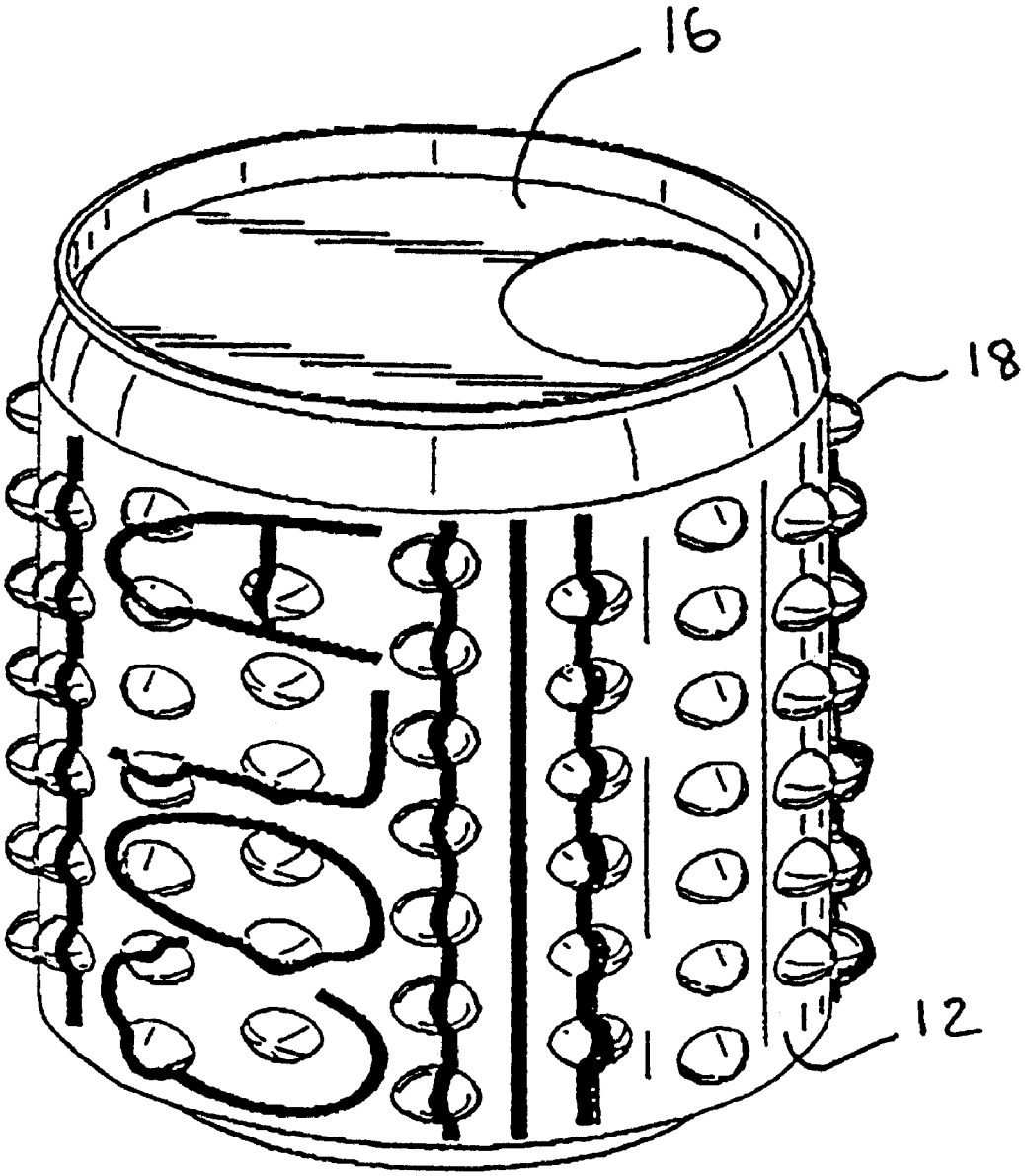
FIG. 19 is front view showing a can with a logo printed and embossed on the surface of a can which is relatively shorter in height and with a larger diameter than a standard size can.

In the wall 12 of the container 10 there are protrusions 18 formed integrally on the exterior of the cylindrical side 12 of the container 10. These can be hemispherically shaped, as shown in FIG. 1 or any other shapes or configurations, including, but not limited to, stripes, diamonds, triangles, stars, animal shapes, etc., as partially shown in FIG. 18. Indeed, the protrusions can take the shape of a logo, trademark or trade name, thereby enhancing its identifiability with the consuming public. In the can of FIG. 7 there is also shown a printed layer on the surface of the can of the lettering of a trademark. These letters and representations rise and fall relative to the overall flat surface of the can. In this manner, the printed lettering forms a generally three-dimensional effect which substantially enhances the can. A similar effect is achieved with the repeating art work designs and logo that are printed and embossed onto the can surface in the embodiments having the protrusions. Such artwork can also have a printed layer on the surface of different coloring over the protrusions to enhance the can. This is illustrated in FIG. 19. The top 16 would be replaced by a compressed top portion 16 as illustrated in FIGS. 2–17.

The protrusions 18 can be concentrated in the regions of the container side 12 whereby a consumer would grasp the container and contact a plurality of protrusions, which are raised with respect to the side surface. The plurality of protrusions enhance the ability of the user to grasp the container, the protrusions providing a gripping means to reduce the possibility providing a gripping means to reduce the possibility of slippage.

In the manufacturing process, the container 10 is made of a thin sheet of metal or metal-like material, such as aluminum, which is pressed and rolled to the proper thickness. The protrusions 18 can easily be formed on the sheets by a stamping process which pushes the protrusions 18 outward on one side and creates indentations on the other side. The protruding side will be positioned on the outer surface, to provide the improved gripping means, and the indentation side shall be provided on the inside of the container, to increase the fluid volume therein. Unlike the prior containers, made of styrofoam or glass, which must be formed by a vacuum injection process, permitting only protrusions on one side without indentations on the other side, the present invention contemplates use of materials which can physically be stamped to provide the combination of an indentation on one side and a protrusion on the other side. This manner of manufacturing can also achieve cost savings, as the volume of the container can be increased without increasing the amount of material used or the size of the container.

A further advantage of the protrusions 18 is that they can be shaped and arranged to convey any message to consumers. The exterior side surface 12 of the container 10 can be designed with various shapes which can be incorporated into the trademark or trade dress of the product. Each protrusion 18 can be colored with patterns or designs or made into a texture to make the container 10 aesthetically distinct and recognizable. One incidental benefit of having the protrusions 18 is that they may also convey particular messages to the blind. Various messages can be placed on containers which can be identified by the blind, such as, for instance, containers containing toxic substances, etc.

The size of such a standard volume can for 12 fluid ounces would be a height of about 5 inches and a diameter of about 2.5 inches, namely a ratio of about 2:1 between the height and the diameter. In these embodiments, the embossed effect allows the contents of the same overall size can to be increased in volume so that, for instance, an extra 0.5 to 1 fluid ounce of liquid can be contained in the can. This would depend on the number of protrusions and the overall depth of the protrusions from the basic surface of the can.

In the embodiment illustrated in FIG. 19, the can illustrated is relatively squatter, namely the can is made shorter in height and larger in diameter. As such the can may have a height of about 4.5 inches and diameter of about 2.5 inches to contain the same 12 ounces of liquid. In such a manner, the ratio of the height to the diameter can change top be less than about 2:1. Alternatively the dimensions can change to form a can of a different structure wherein the ratio of the height to the diameter changes to less than 2:1 to about 1:1.

By having a can of the greater diameter and less height, and with the protrusions, there is less of the contents of the can which is exposed to contact with the hand of a user, particularly where the hand of the user contacts essentially only the protrusions about the surface. Less of the fluid content of the can is in potential contact with the surface of the inner surface of the can.

Figure 20:
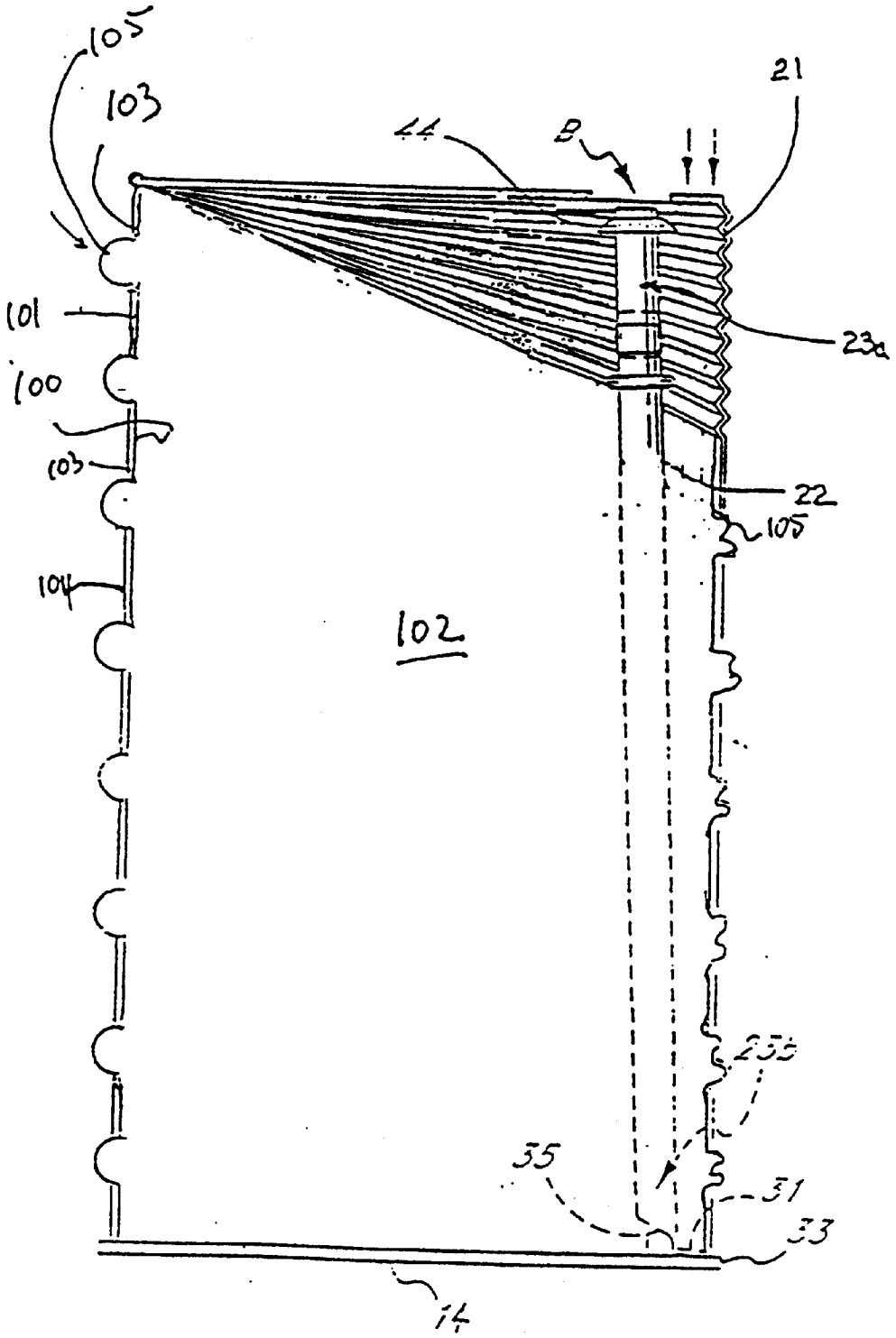
FIG. 20 is a cross-sectional side view of a container having a first body portion and a second body portion. There is a first kind of protrusion formed by the first body portion extending through apertures provided on the second body portion.

As shown in FIG. 20 the first body portion 100 is contained within a cylindrically shaped container as formed by a second body portion shirt 101. The first portion 100 is formed of a plastic sheeting material which can be blow molded or formed within the second body portion 101. The second body portion 101 is made of a thin gauge aluminum material which is crushable under finger pressure when there is no fluid or the like within the body 102 of the container. The second body portion 101 contains at spaced intervals apertures 103 along the surface 104 of the second body portion 101. The apertures 103 can be spaced circumferentially around the surface of the second body portion 101.

By forming the first body portion 100 inside of the second body portion 101, and filling the container with its contents, protrusions 105 are formed to extend outwardly from the surface 104 of the second body portion 101. The protrusions 105 can form any geometric shape that is desired.

As illustrated in FIG. 20, there are hemispherical type bubbles as shown on the left hand side of the body portions of the figure. On the right hand side of the figure the portions are formed so that the protrusion 105 have an irregular shape.

A suitable laminating process can be provided to effectively adhere the first body portion 100 with the second body portion 101. The can may not be collapsible in either the first body portion or second body portion and likewise there may not be a straw 22 within the can. The can may simply be collapsible under the pressure of a hand or finger when the contents are no longer within the can.

By having the second body portion 101 formed in this manner, there can be about 50% of the surface 104 of the second body portion 101 provided with spaces for the apertures through which the first body portion 100 can project. In this manner, the second body portion would need to constitute about 50% of the material normally used in a can with only a single body portion for the can.

There can thus be a relative reduction of the amount of material constituting the second body portion 101. In turn, plastic or the like which may be relatively less expensive can be provided as the first body portion 100 and it can effectively constitute the fluid tight seal for the fluid within the can. The second body portion 101 thus acts as a shirt to provide rigidity to the plastic effectively forming the container. As such, a relatively thin gauge plastic material can constitute the first body portion 100 for the container for the fluid, and the outer second body portion 101 would provide sufficient rigidity to that container.

The protrusions 105 form straight angulated formations with an apex 106 for each of the protrusions 105. In FIG. 20 the curved formations provide the hemispherically type protrusion shapes 105.

The cutout aperture formations in the surface 104 of the second body portion 101 can be shaped to any desired form so that different shapes of protrusions can extend beyond the surface 104 of the second body portion 101.

In different forms of the invention, different combinations of materials can constitute the first body portion and second body portion.

In the arrangements illustrated in the above Figures where the protrusions are spherical or are like a bubble 105 it is desirable that a radius for the bubble is in the range between 0.05 to 0.020 inches, and preferably about 0.15 inches. The same size of bubble should be provided to the embodiments of the invention as illustrated where the bubble is used on the side wall of the container as illustrated in situations, for instance in FIG. 1. This will ensure that there will be effective strength in the can.

By having the materials selected in the nature to be most economical and environmentally advantageous an effectively desirable container is provided. The first body portion 100 can selectively be formed from a synthetic resinous, plastic, cellulose such as a paper or board material, or a metallic material. The second body portion 101 can be formed from a synthetic resinous, plastic, cellulose or a metallic material. In some situations the second body portion may be formed of a foam material or paper. This can provide the additional advantages of providing an insulation affect for the container. In yet other forms the materials for either one of the body portions may be a paper or board. Different degrees of visibility or clarity can be provided to the first body portion and the second body portion.

Many other forms of the invention can be provided. The shape of the container can be a regular cylinder form, square or the like. It could have a neck with a screw or interlocking top, cover or cap for the closure in or with the top portion. The laminated container of the invention can provide hygienic advantages, and avoid internal protective coating usually used in cans. Different methods can be used for laminating the first body portion and the second body portion. There can be a heat or pressure sealing or other interlocking system. As such, the first body portion and the second body portion are essentially inseparable. The system of lamination can be a welding, gluing, heating and/or stamping type of process or a procedure where the two portions are bonded together. In other situations the first body portion and the second body portion are relatively loose. Thus when there is no fluid in the container the body portions may be separable.

Figure 21A:
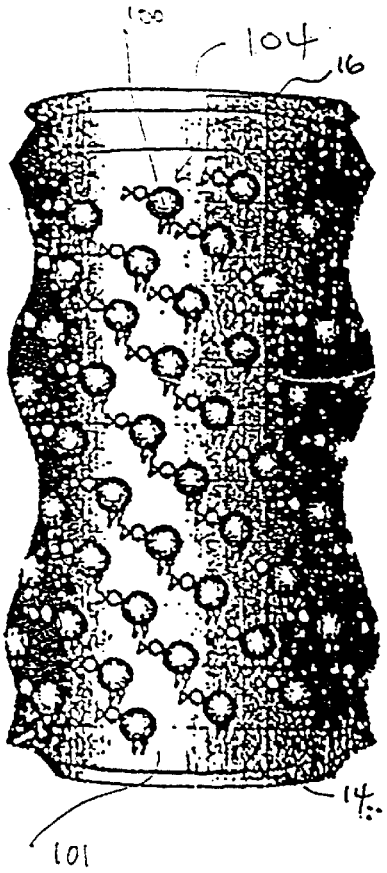
FIGS. 21A to 21D illustrate different side views of cans for fluids.
Figure 21B:
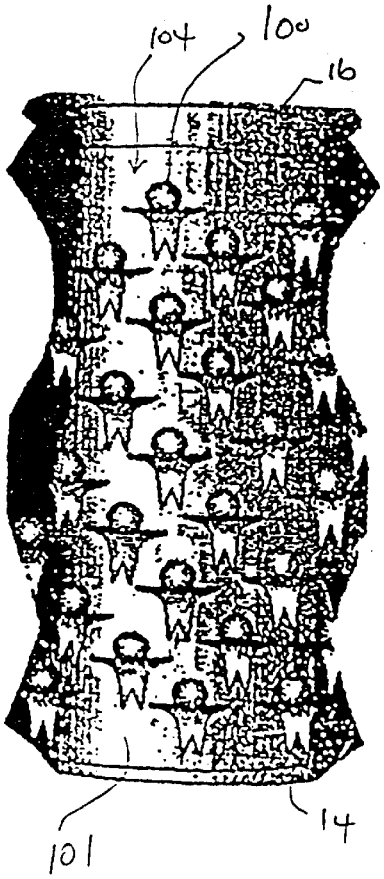
Figure 21C:
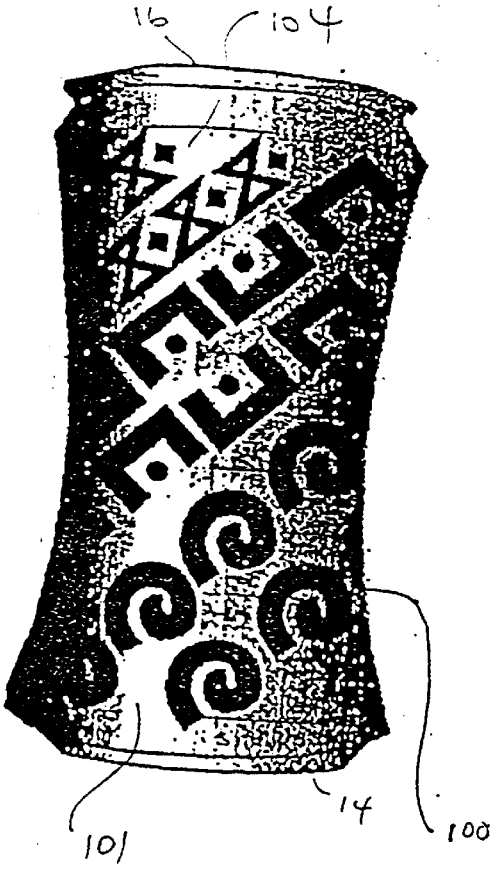
Figure 21D:
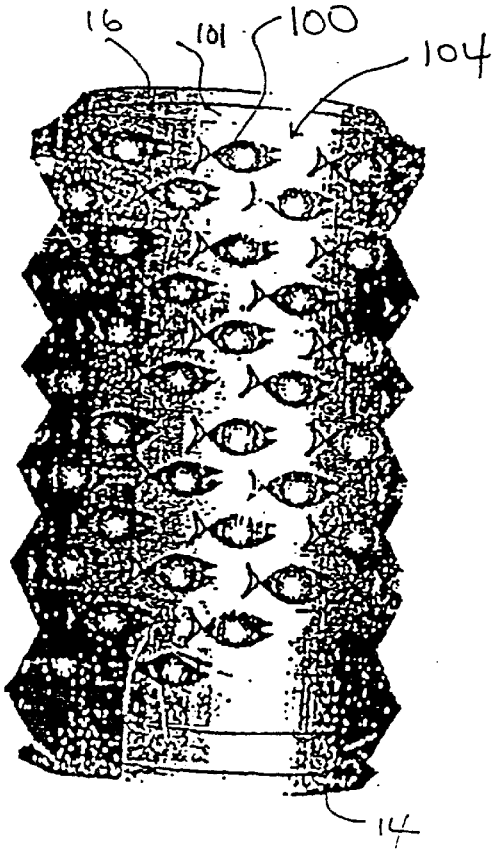
Figure 22:
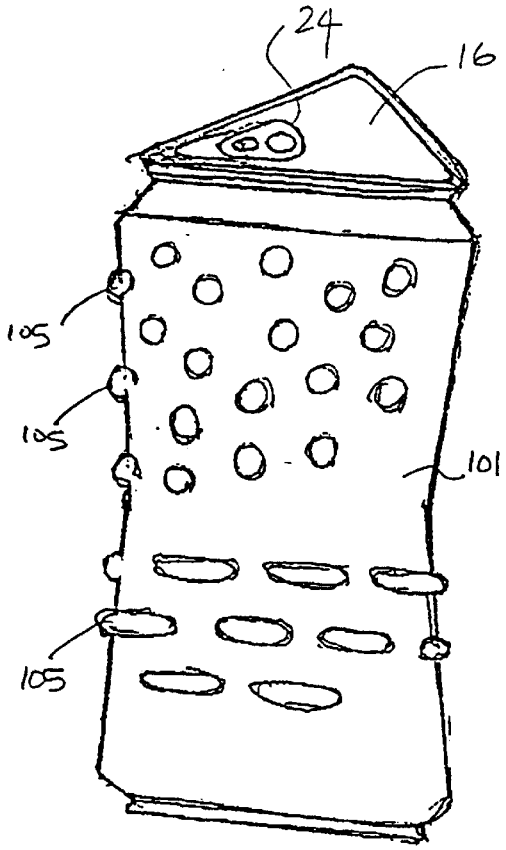
FIG. 22 illustrates a perspective view of a triangulated cross-sectional view of a can in accordance with the invention.
Figure 23:
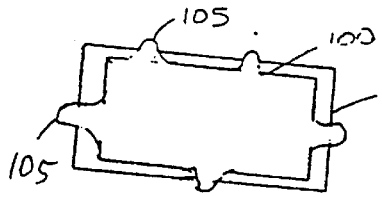
FIGS. 23 to 25 illustrate different cross-sectional end views of respectively a rectangular can, square can and an oval can with the first and the second body portions shown in laminated relationship.
Figure 24:
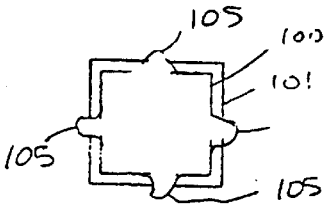
Figure 25:
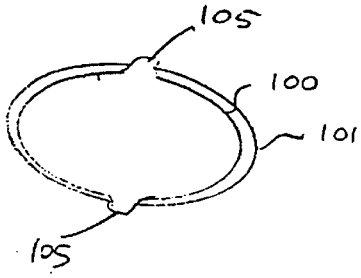

In FIGS. 21A to 21D there are shown situations where different corrugation profiles are provided to the second body portion 101. In FIG. 21A the corrugations are a regular sinuous form about the perimeter of the can. In FIG. 21B the sinuous form is irregular in the sense that the format is angulated. In FIG. 21C the body portion 101 is curved inwardly in the center to form a waist line. In FIG. 21D there is angulated saw tooth pattern for the body portion 101.

On the face of the body portion 101 there are apertures 103 through which the first body portion is visible. The apertures 103 can have different artistic shapes, for instance, a sheep, a human figure, an abstract shape, or a fish as shown in the FIG. 21A to 21D respectively. The first body portion 100 inside the second body portion 101 can protrude beyond the surface of the second body portion 101, or be flush against the inside surface of the second body portion 101. By having the first body portion formed of a material which is at least partly translucent the contents of the can be seen as required. There are different embodiments where it would be desirable for the first body potion 100 to be contained wholly within the second body portion 101. In other situations the first body portion can extend as protrusions through at least some of the apertures.

The cross section of the containers when viewed from the top or bottom may be different to a cylindrical cross-section. Thus the cross-sectional shape may be triangular, rectangular, square, oval, or any other polygonal shape. These views are shown respectively in FIGS. 22 to 25. The container may also be a conventional bottle type shape, namely with a narrow neck.

The top portion 16 of the containers of FIGS. 18–25 would have any one of the compressed top portions as illustrated in FIGS. 2–17.

In some cases the second body portion to does not extend to fully cover the first body portion. In such situations the first body portion could be made of different strengths and thickness over its surface so as that in the areas where there is only the first body portion, that body portion is sufficiently strong to hold the contents of the container.

The overall rigidity to the can be provided by a combination of the first and second body portions or by either one of the body portions. In some cases the second body portion is essentially ornamental and provides little of the structural strength to the can. The first body portion and the second body portion can be joined by a suitable heating or vacuum forming process.

The container can be for holding different contents and fluids. The thickness and strength of the walls of the first and second body portions respectively can be established according to the weight to be held by the container.

There can be protrusions on the surface of the second body in addition to the apertures in the surface of the second body. In this manner there is a combination of protrusions provided by both the first body portion and the second body portion. In some cases the first body portion acts as an internal type vest and the second outer body portion is the container for the fluid.

The principles of the present invention, as pointed out above, are equally applicable to containers of all configurations and dimensions, and should not be construed as being limited to those shown in the drawings. For instance, the top with the corrugated interlocked lid can be used with a glass or plastic bottle container. Also shown on the exterior of the cylindrical side surface of the container are raised protrusions 18 which provide several advantages, as described more fully below.

In some variations it is unnecessary to have the strip 34. The interlocking corrugations pleated, wrinkled, or scrolled member can be formed with sufficient strength and rigidity to retain the first depressed position until the spout is moved. This can be by a pushing action, upwards or downwards, to release the corrugations or the scrolled member forming the top 16. Interlocking elements can be used to hold the interlocked corrugations, pleats, wrinkles, or scrolls in the first portion. Pushing down on the cover 26 over the spout 31 acts to break free the interlocking elements or inherent rigidity of the corrugations or scrolled member to permit the expansion of the top 16 to the second position. The interlocking elements can be located between different folds of the corrugations at discreet locations. In other forms, the corrugations or scrolling elements can be other suitable wrinkle formations.

Figure 26:
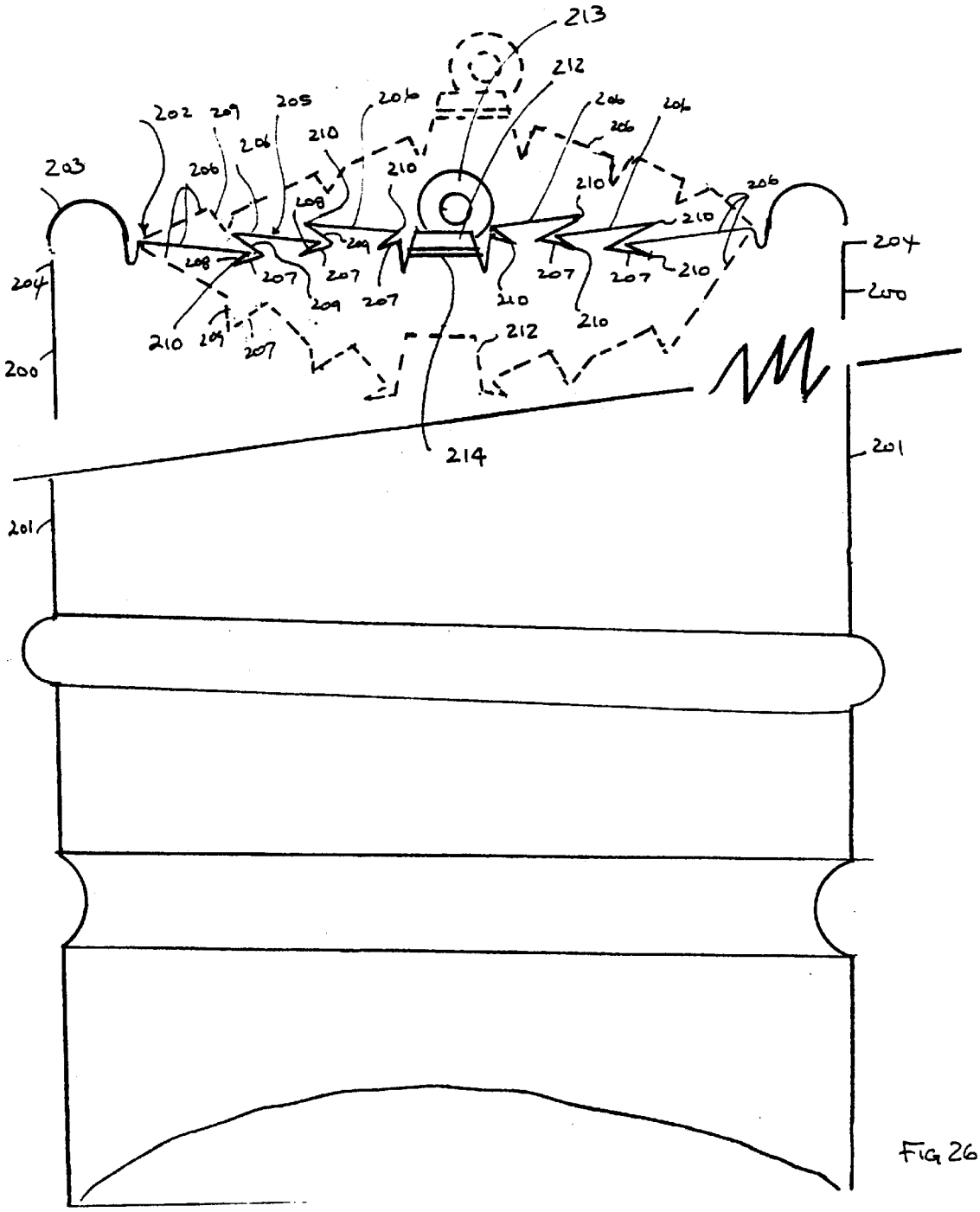
FIG. 26 is a representative side view showing a top in three possible positions relative to a container.

In FIG. 26 there can be seen a container neck 200 which can be part of the container 201. or 201 can represent the extended neck portion of a bottle.

The lid portion 202 is formed by circumferential or peripheral anchoring elements 203 to engage the top portion 204 of the neck 200. This can be an engagement whereby a crimping is effected to that the anchoring ring 203 is firmly and solidly affixed and anchored with the top portion 204.

In the solid line 205 there is shown the lid portion in the sealed configuration, namely, width circumferential ribs 206 anchored or interlocked with circumferential ribs 207. The ribs 206 and 207 have two joined sections 208 and 209, respectively. The points joined between the joined sections 208 and 209 with each of the ribs 206 and 207 respectively can have a relative weakness at its apices. This can be caused by a material weakening or a thinning of the gauge of the material at those particular points. This will facilitate movement of the lid as appropriate. Each of these apices are indicated by numeral 210.

At the center portion of the lid there is a spout 212 with an optional tab 213. The tab is affixed to the spout 212 by means of a ring 214.

When formed, the lid is created as an integral item so that the corrugations, wrinkles, shapes, or pleats formed by the ribs 206 connecting portions 208 and 209 and ribs 207 are formed ideally in a single operation. This formation of the lid can be effected by a heat sealing process or stitching or welding, possibly electrowelding so as to maintain the interlock position. A suitable design of the material forming the lid at its different points can effect the interlock operation of the lid.

By pushing down on the spout 212, the action will be to break the interlock formation so that the different components are relatively non-locked and there is minimal overlapping of the ribs 206 connecting portions 208, rib 207 and connecting portions 209. By thereafter pulling upwardly on the tab 213 or allowing the carbonated fluid in the container 219 to push the lid upwardly, the lid adopts the shape as shown in dotted lines and extending above the level of the anchoring rings 203. In some cases, the depressed position of the lid can mean that any one or more of the sections 206, 208, 207 and 209 fall into a single planar length as it is extended from its non-interlock position. In this sense, FIG. 26 illustrates only a representative example of how the interlocked portions shown in solid will adopt a different position when shown in the noninterlocked format. In some situations, the different sections 206, 207, 209 and 210 will fall into a substantially planar face.

In the different forms of the invention, the portion containing the aperture and the cover member can be located in what is normally regarded as the underneath or bottom portion of the cavity.

The invention is to be determined by the following claims.

What is claimed is:

1. A metal can for at drinking beverage comprising:

an elongated generally cylindrical body portion having first and second ends, the body portion being a non-resilient, non-plastic metal material;

a bottom portion integrally formed with and sealing the first end;

a substantially planar top portion sealing the second end and having an aperture;

a cover member releasably secured to the top portion for sealing the apertures, wherein the cover member provides a closed cavity suitable for containing a beverage fluid without fluid communication therethrough, and wherein the cover member is essentially flush with the top portion when in a sealing position;

the body portion having a curved wall and having disposed thereon and embossed thereon a pattern of protrusions of a preselected shape, height and configuration, the protrusions extending generally in a pattern over the curved wall area of the body portion from the first end to the second end or positions inset from at least one of the first end or the second end, the protrusions enhancing the exterior periphery of the body portion by providing traction thereto, and the body portion further having indentations relative to the curved wall and the protrusions extending outwardly relative to the curved wall of the can relative to the can without embossing or relative to the indentations; and the body including an outside surface, and including a printed layer of an ornamental representation on the outside surface, the ornamental representation acting to enhance the ornamental effect of the surface, and the ornamental representation including in at least some part printed lettering, and at least some put of the ornamental representation extending over the protrusions from the curved wall of the can, over the protrusions and returning to the curved wall, thereby to form a generally three-dimensional effect which substantially enhances the can, and the lettering extending circumferentially around the can.

2. A metal can as claimed in claim 1 wherein the cylindrical body define a waist line between the first and second ends.

3. A metal can as claimed in claim 2 wherein the body is formed of an aluminum thin gauge material, the material being selectively crushable under finger pressure when the can is empty, and the body of the can being formed with protrusions by a stamping process.

4. A metal can as claimed in claim 3 wherein the printed ornamental representation and the protrusions are formed such that there is a relatively non-distorted shape or form of the lettering.

5. A metal can as claimed in claim 1 wherein the body is formed of an aluminum thin gauge material, the material being selectively crushable under finger pressure when the can is empty, and the body of the can being formed with protrusions by a stamping process.

6. A metal can as claimed in claim 1 wherein the printed ornamental representation and the protrusions are formed such that there is a relatively non-distorted shape or form of the lettering.

* * * * *